United States Patent [19]

Schuster

[11] 4,193,432

[45] Mar. 18, 1980

[54] SELF-STEERING APPARATUS FOR SHIPS

[75] Inventor: Jürgen Schuster, Munich, Fed. Rep. of Germany

[73] Assignee: C. Plath, Hamburg, Fed. Rep. of Germany

[21] Appl. No.: 860,091

[22] Filed: Dec. 13, 1977

[30] Foreign Application Priority Data

Dec. 15, 1976 [DE] Fed. Rep. of Germany ..... 2656839

[51] Int. Cl.[2] ..... B63H 25/04

[52] U.S. Cl. ..... 114/144 C; 114/150

[58] Field of Search ..... 114/144 R, 144 C, 144 E, 114/150, 185; 244/76 B, 82, 203, 90 B; 91/457

[56] References Cited

U.S. PATENT DOCUMENTS

| | | | |
|---|---|---|---|
| 2,771,052 | 11/1956 | Halverson | 114/185 |
| 2,925,060 | 2/1960 | Weeks | 114/144 R |
| 3,390,614 | 7/1968 | Tatum | 114/144 E |
| 3,798,525 | 3/1974 | Cooper | 114/144 E |
| 4,059,064 | 11/1977 | Dickey | 114/144 E |
| 4,091,758 | 5/1978 | Rosen | 114/144 C |

*Primary Examiner*—Sherman D. Basinger

*Attorney, Agent, or Firm*—William A. Knox

[57] ABSTRACT

An automatic control device for ships, more especially sailing ships, consisting of a feeler for detecting a difference between an actual value and a required value of the ship's direction and a regulator which is controlled by the feeler and positions a rudder of the ship, when a difference between the actual value and the required value occurs, in such a way that the difference is reduced.

8 Claims, 7 Drawing Figures

1
61
A
3
5
7
11
9
A
B
B
57
19
59
17
13
45
55
51
43
15
47
12

11
9
5
53
1
17
7

31
29
37b
37
33
35
37a
41
38
39
23
43
27
25
21

SELF-STEERING APPARATUS FOR SHIPS

BACKGROUND OF THE INVENTION

1. Field of the Invention

This invention relates to an automatic rubber control device for ships and more especially for sailing ships.

2. Description of the Prior Art

On known automatic control devices, a feeler means is in most cases a wind vane which is rotatably fitted to the stern of the ship and is connected, via a regulating means in the form of a transfer rod linkage, to an auxiliary rudder which is fitted to the transom of the ship and is specially adapted to the automatic control device. The length of the individual lever members in the transfer rod linkage is adjustable, so that the auxiliary rudder can be aligned parallel to the longitudinal direction of the ship in every position of the wind vane. In this way, it is possible to set the required position of the wind vane and consequently the required course of the ship.

If the actual course of the ship differs from the required course, the position of the wind vane, which is directed by the apparent wind (actual wind plus the wind caused by the speed of the ship), is changed relative to the ship. This causes the auxiliary rudder to be positioned in such a way that the ship returns to its required course. The influences causing the ship to go off course are very varied due; for example, to waves acting on the ship' hull, a varying tendency of a sailing ship to carry a lee or weather helm, depending on the force of the wind and the rigging, etc.

In the case of known automatic control devices which are constructed as described above, the force for actually actuating the auxiliary rudder has been applied by the wind vane. The latter is therefore a large, bulky unit which has to be attached to the ship in a suitably firm manner and requires a certain minimum wind force in order to be effective. The auxiliary rudder must also be very rugged and must be securely mounted on the transom, so as to ensure that the automatic control device will continue to operate reliably even in rough seas. All in all, the described automatic control devices are thus bulky in design, relatively expensive and necessitate elaborate measures for their secure fastening to the ship.

Another known automatic control device comprises as the regulating unit one or several electric motors which are controlled from the wind vane and actuate the rudder. Although such an automatic control system does not require an additional auxiliary rudder, it has the serious disadvantage that it necessitates an efficient power source which is very rarely provided on board, particularly on board a sailing ship, and which, if provided, can be relied on to a limited extent only.

SUMMARY OF THE INVENTION

The task underlying the invention is to provide an automatic control device for ships, more especially sailing ships, which combines a simple construction with a high operational reliability and which can be fitted to the respective ship in a simple manner.

According to one embodiment of the invention, this task is solved with the aid of an automatic control device of the kind described at the beginning in that the regulating means comprises, as the energy source for actuating the rudder, a Venturi tube which is immersed in the water.

Such a Venturi tube can be secured to the ship in a simple manner. At a resistance which is negligible compared with the ship's other resistance to water, if produces a vacuum which is dependent on the speed at which the ship travels through the water and with the aid of which if it possible to produce in various ways a force which is used for positioning the rudder. An automatic control system according to the invention has thus no need of an expensive auxiliary rudder, nor does it require an efficient power source on board. The production of a vacuum with the aid of the Venturi tube starts already at low speeds of the ship, even small vacuums being capable, by the application of these pressures to areas of corresponding size, of producing large forces which reliably actuate the rudder.

An advantageous constructional form of the automatic control device is characterised in that the regulating unit comprises a bellows which is connected to the rudder at one end and to the ship at the other end and whose interior can be optionally connected to the atmosphere and/or the Venturi tube via a valve actuated by a feeler or wind sensor means.

This regulating unit is particularly simple in construction, comprising only the bellows and the flap valve actuated by the feeler means. The bellows is connected to the valve by one air line and the valve is also connected to the Venturi tube via another air line, each of which may be a hose. All the components can be produced very economically and can be connected together in a simple manner. The bellows, to which atmospheric pressure or the vacuum produced by the Venturi tube is selectively applied by the feeler means via the control of the valve, operates between the rudder of the ship and a part which is rigidly connected to the ship's hull. The appropriate choice of its effective cross section and admissible stroke allows the automatic control device to be adapted to different ships, depending on what rudder deviations and what forces are required for course changes.

Advantageously, two or more bellows may be arranged one behind the other between the rudder and the ship. By this means, the force to be applied to the rudder can be increased.

Preferably, a spring side of the rudder opposite to the bellows. This spring endeavours continuously to expand the bellows so that the position of the dynamic equilibrium of the bellows (bellows length at which the position of the ship's rudder is such that there is no difference between the actual ship's heading and the required ship's heading) is a condition in which a partial vacuum is already applied to the bellows from the Venturi tube. This improves the response behaviour of the automatic control device.

In a further embodiment of the preferred automatic control device, which is preferred in practice, at least one bellows acts on both sides of the rudder and the bellows arranged on different sides of the rudder are connected in opposite directions to valves actuated by the feeler means. In this way, respectively one bellows exerts a pull on the rudder, while the other does not exert any force and vice versa, so that the forces exertable on the rudder are high and do not depend on the sign of the difference between the actual heading and the required heading.

The valve actuated by the feeler means in advantageously a three-way valve having a chamber which is connected to the interior of the bellows and includes two openings, one of which is connected to the Venturi tube and the other of which is connected to the atmosphere and within which there operate valve flaps which are actuated by the feeler means and which are interconnected in such a way that they optionally shut one or the other of the openings. Such a valve has various advantages:-To begin with, the force required for its actuation is very small, so that there is no need for the feeler means itself to apply large forces directly to the regulating means, which has a favourable influence on the response behaviour. Furthermore, the stroke required for the actuation of the valve (movement of the flaps) is small, which also has a favourable influence on the response behaviour. The neutral operating position of the valve, i.e., the position at dynamic equilibrium, is a position in which both valve flaps are partially open so that there prevails in the bellows a pressure which is between the atmospheric pressure and the pressure supplied by the Venturi tube. If a course correction of the ship is required, then a very small movement of both valve flaps is sufficient for a considerable change of the pressure to occur in the bellows, causing a corresponding change of the rudder position angle and thus the necessary course correction angle. The automatic control device thus responds very sensitively. Due to the damping provided by the throttling of the air flow occurring in the lines, there is no tendency for hunting or surging. This throttling may be additionally adjustable by appropriate restrictors.

Another constructional form of the automatic control device is destinguished in that the regulating unit comprises a movable wall which is connected to the rudder and is arranged between two work chambers in a sealing manner and in that valves connected to the work chambers are actuated by the feeler means in such a way that, when there is agreement between the actual heading and the required heading, both work chambers are connected to the atmosphere and are pressure equalized and, when a difference in headings exists, they are respectively connected to openings in the Venturi tube to which different pressures are applied.

The last-mentioned constructional form has the advantage that the pressure differential which is effective across the movable wall in a control deviation is derived only from the Venturi tube, so that momentary fluctuations of the water depth in which the Venturi tube is located have no influence on the forces exerted on the rudder by the movable wall.

Widely varying feeler means may be used for the automatic control device according to the invention. For example, it is possible to use a wind vane, whose location on the ship need not be the stern, which is of advantage, especially in the case of mizzen-masted sailing boats, since the wind is frequently disturbed to a considerable extent and therefore changeable on the stern of these ships and there is often also no room for the wind vane to operate without colliding with the sail used on the second mast. Due to the fact that only a small force and a small stroke are required for the actuation of the valves or valve, the wind vane can be smaller than the conventional wind vanes without any impairment of the efficiency of the automatic control device.

It is also possible to use a compass provided with contacts as the feeler means. In this case, a presettable compass course can be automatically steered with the automatic control device in known manner, in that the contacts close when the actual course differs from the required course, causing the valve or valves to be actuated. Using the automatic control device according to the invention has the advantage that the current consumption of electro-magnets used, for example, for actuating the valves, can be kept very low, since these magnets can operate with small forces and a small stroke.

Practice has shown that the automatic control device according to the invention works reliably even in difficult conditions and also stays reliably on a downwind course when operating with a wind vane as the feeler means, which is hardly possible with conventional automatic control devices, unless these work electrically.

The entire automatic control device consists, for example, only of a relatively small wind vane which is fitted to the ship so that it can be swivelled about a pin, a three-way valve which is actuated by the wind vane, a Venturi tube which is immersed in the water, a bellows actuating the rudder, a hose line between the Venturi tube and the three-way valve and another hose line between the three-way valve and the bellows as well as possibly a spring acting on the rudder side that is remote from the bellows. All these parts can be manufactured in a simple and therefore economic manner, are of low weight and can be attached to the ship in a simple manner without the need to provide any disturbing attachments and installations on the ship. Of course, the bellows does not have to act directly on the rudder but may be arranged in a protected place, for example below deck and/or be accommodated in a tube, and may be connected to the rudder via a rope running over one or several guide pulleys.

The automatic control device according to the invention can be used both for very large and for very small ships, for example jolly boats. It can furthermore be used both for ships whose rudderblade is actuated from a tiller and for ships equipped with wheel steering, in that in the first case it acts on the tiller and in the second case directly on the wheel or on a component of the wheel steering performing a linear movement, for example a transfer member between the steering wheel and the shaft of the rudder blade or one end of a two-arm lever which is usually rigidly secured to the shaft of the rudder blade.

BRIEF DESCRIPTION OF THE DRAWINGS

Hereinafter, the invention will be explained by way of example with reference to the drawings and with further appended details, wherein.

DETAILED DESCRIPTION OF THE PREFERRED EMBODIMENTS

Figure 1:
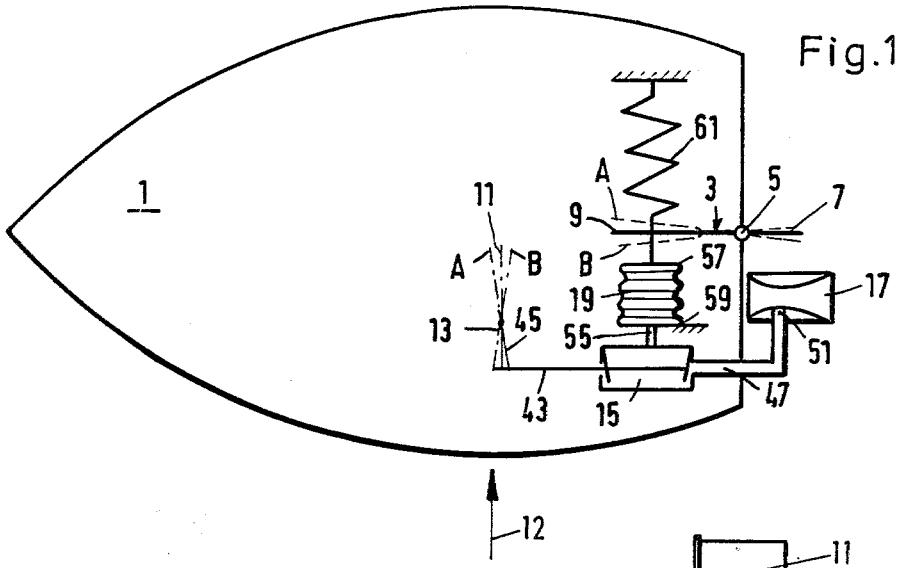
FIG. 1 is a top view of a ship equipped with an automatic control device.
Figure 2:
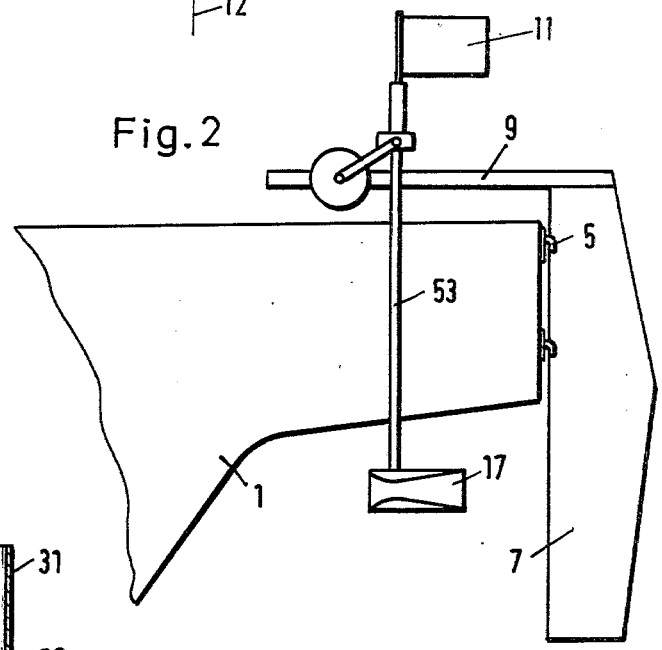
FIG. 2 is a side view of the stern of a ship equipped with the automatic control device.

As shown in FIGS. 1 and 2, a ship 1, which may be, for example, a sailing ship whose rigging is not shown, comprises with a rudder blade 7 a rudder 3 which is rotatable about an axis and can be positioned from a tiller 9.

A wind vane 11, which may be, for example, a metal plate, is furthermore mounted on the ship so that it can be pivoted about a pin 13. The wind vane may be attached to any point of the ship 1 where it causes little obstruction and where the wind has a good possibility of sweeping over it.

The wind vane 11 forms the feeler means of the automatic control device, whose regulating means essentially includes a three-way valve 15, a Venturi tube 17 and a bellows or collapsible chamber 19.

Figure 3:
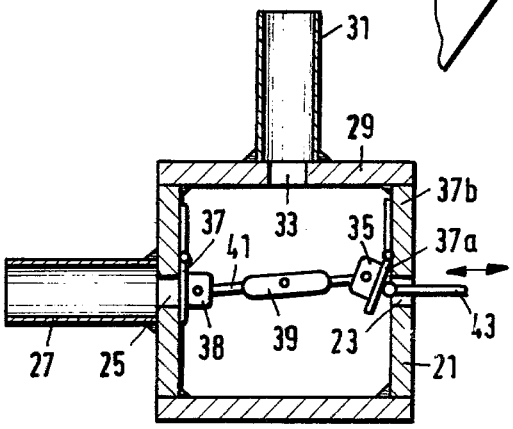
FIG. 3 is a cross section through a valve of the automatic control device.

As shown in FIG. 3, the three-way valve 15 comprises a housing 21, which consists, for example, of plastics material and in whose side walls openings 23 and 25 are formed, the opening 25 being provided with a hose liner 27. The housing 21 is hermetically sealed by a cover 29 which comprises another opening 33 provided with a hose liner 31. In front of each opening 23 and 25, there is arranged in the housing 21 a valve flap 35 and 37, which may be, for example, a small rubber plate which is glued to the housing 21 above the associated opening or is glued, as shown, to a stiff small plate 37*a* which, in turn, is hingedly connected to another stiff small plate 37*b* fastened to the housing 21. Both valve flaps 35 and 37 are connected via a rod 41 which can be adjusted in length by means of a threaded sleeve 39. The connection of the valve flaps to the rod is effected, for example, in that each valve flap is held between two nuts screwed on the rod, an additional gluing being possibly provided, or in that, as in the example shown, the rod 41 is hingedly mounted in small rubber sponge blocks 38 which are glued to the laminae 37*a* of the valve flaps 35 and 37. The rod 41 extends through the opening 23 and forms an actuating member 43 for actuating the three-way valve 15. This actuating member which, in turn, is adjustable in length (not shown), is hingedly connected to a lever 45, as shown in FIG. 1, which lever extends the wind vane 11 beyond its pivot 13.

A hose 47 is taken from the hose liner 27 to an opening 51 formed in the Venturi tube 17 on the narrowest cross-sectional area thereof. This Venturi tube 17 is arranged, for example by means of a rod 53 (FIG. 2) attached to the ship 1 so that it can be adjusted in height relative to the ship, at a point where the current formed as a result of the ship 1 travelling through the water reliably flows against it, even with a heeling ship 1. Such a point is, for example, beneath the ship' stern somewhat below the water line or beneath the ship's bow. The Venturi tube may also be fixedly fastened to the ship's hull itself, when the hose 47 is advantageously partially replaced by a line which is taken in a sealing manner through an opening provided in the ship.

Another hose 55 is taken from the hose liner 31 of the cover 29 into the interior of the bellows 19, which comprises two side plates 57 and 59, of which one, 59, is connected to the ship's hull and the other, 57, is connected to the tiller 9. The connection may be effected, for example, with a rope or hingedly fitted rods. On the side of the tiller 9 that is remote from the bellows 19, there is provided a spring 61 which operates between a part which is fixed to the ship and the tiller 9 and which is advantageously adjustable, being designed, for example, as a rubber sling so that the tension exerted by it on the tiller 9 can be adjusted.

The operation of the described automatic control device is as follows:

The three-way valve 15 is connected to the wind vane 11 via the actuating member 43 or the lever 45 thereof in such a way that the two openings 23 and 25 of the three-way valve 15 are both partly opened when the ship's direction agrees with the required direction and the wind vane 11 points exactly in the direction of the apparent wind as shown by arrow 12 in FIG. 1. There is then formed in the bellows 19 a pressure which is between the atmospheric pressure (open opening 23) and the vacuum (open opening 25) provided by the opening 51 of the Venturi tube 17, through which water flows. The adjustment of the tension in the spring 61, the effective length of the rod 41 between the valve flaps 35 and 37 and the length of the actuating member 43 allow this pressure to be adjusted or proportioned by valve 15 is such a way that it differs distinctly both from the atmospheric pressure and from the pressure prevailing in the opening 51 of the Venturi tube 17.

The pressure, p, prevailing in the opening 51 of the Venturi tube 17 is calculated in accordance with the generally known theory of such a tube- $$p = p_a + s \cdot g \cdot h - \frac{1}{2} s \left(\frac{r_a}{r_i}\right)^4 \cdot v^2,$$

wherein $p_a$=atmospheric pressure in bars, s=density of the water in g/cm$^3$, g=acceleration due to gravity in cm/s$^2$, h=distance of the opening 51 from the water level, $r_1$=largest radius of the Venturi tube, $r_2$=smallest radius of the Venturi tube, v=speed of the ship in cm/s.

Of course, the formula applies only in ideal circumstances; in practice, losses occur due to the internal friction of the water, so that the ship's speed v is not entered in its full value. In practice, the expression s.g.h can be neglected with respect to the expression $$\frac{1}{2} s \left(\frac{r_a}{r_i}\right)^4 \cdot v^2$$

at a ratio of $r_1$:$r_2$=3 and a ship's speed of v=50 cm/s (=1 knot), so that the last expression in the above formula indicates directly, for the conditions prevailing in most cases in practice, the vacuum prevailing in the opening 51 relative to the atmosphere (the efficiency of the Venturi tube having, of course, to be additionally taken into consideration).

If the ship's course differs from the required value, the wind vane is deflected from its required position, due to the change in the direction of the wind relative to the ship 1 which follows such a difference, and has, for example, the position A, shown in broken lines in FIG. 1. In this position, the actuating member 43 has been shifted to the right, as shown in FIG. 3, whereby the valve flap 35 is opened further and the valve flap 37 closes the opening 25 to an increasing degree. The interior of the bellows 19 is thus connected to the atmosphere through a larger opening than previously so that the pressure prevailing therein rises. The bellows 19 expands under the action of the spring 61 and moves the tiller 9 with the rudder 3 to the position A, also shown in broken lines in FIG. 1. The course of the ship 1 is changed so that the wind vane 11 turns back in the direction of its original position. The valve flap 37 again tends to open increasingly, and valve flap 35 moves in the direction of its closing position, and the earlier equilibrium is restored.

If the ship goes off the required course in the opposite direction (position B of the wind vane shown in dash-dotted lines in FIG. 1), vacuum is increasingly applied to the interior of the bellows 19 from the Venturi tube 17, the bellows 19 is shortened, and the course of events is the reverse of that described above.

A feature essential to the functional reliability of the invention is the fact that the bellows 19 operates at a pressure which is between the atmospheric pressure and the lesser pressure in the Venturi tube 17, and in that it is aerated in each case from the atmosphere. This aeration from the atmosphere renders possible the large throughputs of air which are necessary for changing the length of the bellows 19 and for the action the latter takes on the tiller. In the previous usual applications of a Venturi tube, for example for measuring the speed of a fluid flow, such throughputs controlled by the Venturi tube are not required, since the Venturi tube is simply connected to, for example, a mercury gauge.

As discussed above, the automatic control device is in dynamic equilibrium when the required course and the actual course are identical, that is to say air flows constantly in a balanced manner from the atmosphere through the openings 23 and 25 to the Venturi tube 17, within which it passes into the water flow through opening 51. The automatic control device responds very sensitively, but is adequately damped by the flow resistances of the hoses, so that it regulates without any overswings.

Good results were achieved in practice with a yacht of 6.85 m length, 2.4 m width, 1.2 m draught, 24 m sail area and an automatic control device of the following main dimensions: size of the wind vane 50×20 cm, bellows diameter 20 cm, allowable stroke of the bellows 10 cm, outside diameter $r_a$ of the Venturi tube 6 cm, $r_a:r_i=3$, diameter of the hoses and openings 8 mm, length of the hose from the valve to the Venturi tube approximately 2 m, length of the hose from the valve to the bellows approximately 1 m, fastening of the Venturi tube to the stern by means of a rod, approximately 20 cm below the water surface.

Adequate forces were available at as low a speed of the ship as 2 knots. At 4 knots, forces of 20 kp were measured. The ship stayed perfectly on course even under very difficult conditions (heavy seas), even when the position of the sails was changed or the foresail was furled. The automatic control device also operated satisfactorily on downwind courses.

Figure 4:
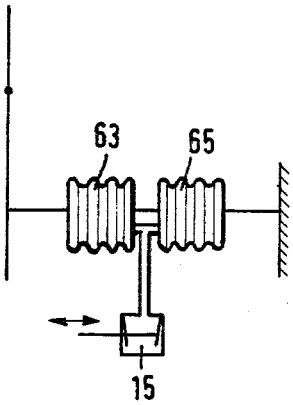
FIGS. 4 to 7 are different constructional forms of automatic control devices.

FIG. 4 shows two bellows 63 and 65 arranged one behind the other, these bellows being connected to the three-way valve 15 in the same manner. This allows the stroke, i.e., the distance by which the tiller 9 of the rudder 3 or another component connected to the rudder can be moved, to be increased.

Figure 5:
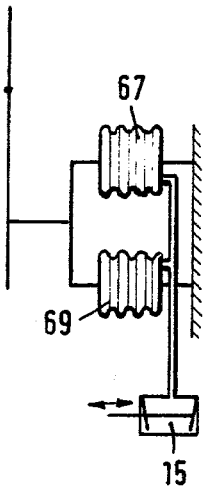

In the constructional form shown in FIG. 5, two bellows 67 and 69 are attached in parallel to the tiller 9 and are connected in the same sense to the three-way valve 15. In this way, it is possible to double the force with which the tiller 9 can be actuated in the automatic control.

Figure 6:
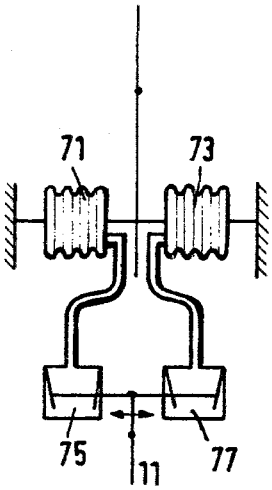

FIG. 6 shows a constructional form in which a bellows 71 and 75 respectively, which is connected to an associated three-way valve 75 and 77 respectively, acts on each side of the tiller 9. The three-way valves 75 and 77 are actuated by the wind vane 11 in opposite senses, so that a vacuum is applied to respectively one bellows relative to the pressure prevailing therein in a dynamic equilibrium and the other bellows operates at an excess pressure. This constructional form of the automatic control device thus operates fully symmetrically with respect to its neutral position of equilibrium (agreement between the required heading and the actual heading, which brings about a particularly satisfactory regulation.

Figure 7:
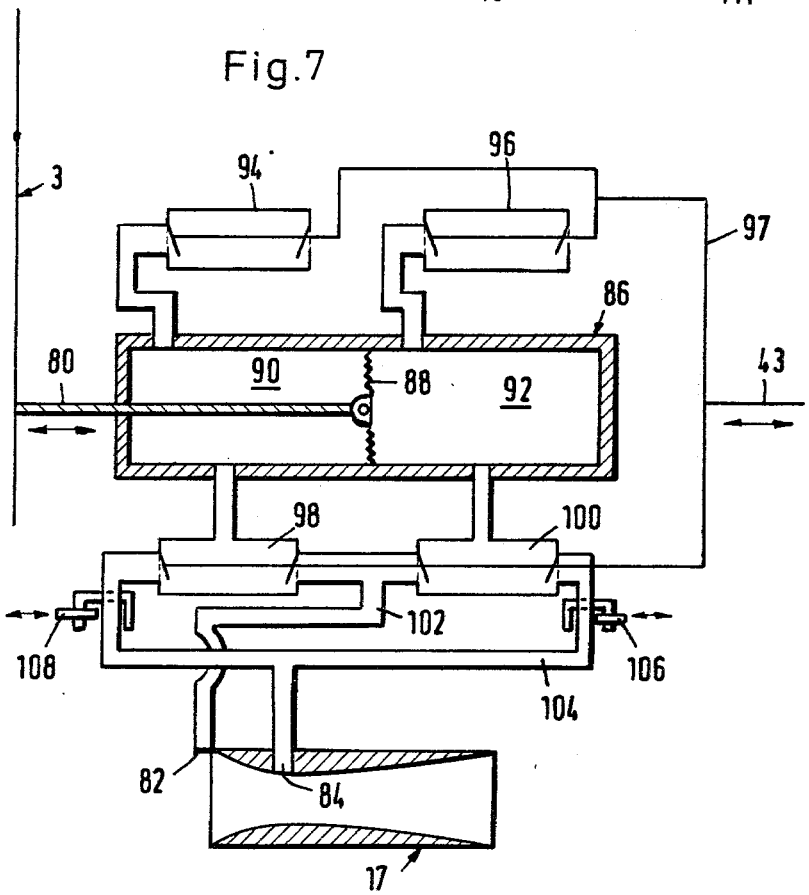

FIG. 7 shows a constructional form in which the rudder 3 is actuated by a piston rod 80 at a force which is derived from the pressure difference between two under-water openings 82 and 84 of the Venturi tube. This constructional form comprises a housing 86 with two working chambers 90 and 92 which are separated by a movable wall 88, which may be a piston guided in the housing 86 in a sealing manner. Each working chamber 90 and 92 is connected to a three-way valve 94 and 96. The valve flaps of the three-way valves 94 and 96 are connected to the actuating member 43, actuated by the wind vane, via a rod linkage 97. The working chambers 90 and 92 are furthermore connected to the interior of two further three-way valves 98 and 100, whose openings that point to each other are connected to the opening 82 of the Venturi tube 17 via a line 102 and whose openings that are remote from each other are connected to the opening 84 of the Venturi tube 17 via a line 104. The valve flaps of the three-way valves 98 and 100 are also jointly actuated by the actuating member 43.

If the actuating member moves, for example, to the left, the working chambers 90 and 92 are separated from the atmosphere, as they also are when the actuating member 43 is moved to the right, by means of the three-way valves 94 and 96. The working chamber 90 is connected to the opening 82 of the Venturi tube 17 via the three-way valve 98, whose left-hand valve flap closes and whose right-hand valve flap continues to open; the working chamber 92 is connected to the opening 84 of the Venturi tube 17 via the three-way valve 100, whose left-hand valve flap closes and whose right-hand valve flap continues to open. The working chamber 90 is thus ventilated to a lesser extent than the working chamber 92; the movable wall 88 moves to the right and shifts the rudder 3 accordingly. If the actuating member 43 moves to the right, then the rudder 3 moves to the left reversely to the course of events described.

Throttles 106 and 108, which reduce the air throughput and accordingly the speed of the response of the automatic control device, may be provided in the lines 102 and 104. Of course, the throttles may also be provided in the other constructional forms of the automatic control device which have been described.

The opening 82 shown in FIG. 7 may be formed so as to point to the rear or to be already within the Venturi tube, in order to ensure that the current corresponding to the ship's speed reliably flows towards it. It may also be formed so as to point to the front, so that dynamic pressure is applied thereto. In this case, it is possible for water to rise in the device to a greater or lesser degree.

According to the invention, the Venturi tube may be replaced by another known means which produces a differential pressure due to the relative movement to the water. An example is a body with a surface that is disposed transversely to the direction of the relative movement, a higher pressure (dynamic pressure) arising on the front of this body than on the rear thereof. Another example is the so-called Prandtl Pitot tube.

I claim as my invention:

1. An automatic rudder control device for a ship including a feeler means, responsive to the apparent wind direction for detecting a difference between an actual value and a required value of the ship's heading and a rudder actuating means that is controlled by the feeler means for positioning the rudder of the ship, so that when a heading difference occurs, the rudder actuation means changes the rudder angle to reduce the difference, the rudder actuation means comprising:

a Venturi tube immersed in the water, having a low pressure opening; a regulating means comprising a bellows that is directly connected to the rudder at one end and to the ship at the other end and whose interior volume can be optionally connected to atmospheric pressure and to the low pressure opening in the Venturi tube in desired proportions via a valve actuated by the wind-responsive feeler means.

2. An automatic control device as claimed in claim 1, wherein two or more bellows are arranged in series, one bellows behind another bellows between the rudder and the ship.

3. An automatic control device as claimed in claim 1, wherein at least two bellows are arranged in parallel between the rudder and the ship.

4. An automaitc control device as claimed in claim 1 wherein a spring acts on the side of the rudder opposite to the bellows.

5. An automatic control devices as claimed in claim 1 wherein at least one bellows acts on each of the rudder and wherein the bellos arranged on opposite sides of the rudder are connected in the opposite sense to said valving that is actuated by the feeler means.

6. An automatic rudder control device for ships which includes a feeler means for detecting a difference between an actual value and a required value of the ship's direction and a regulating means which is controlled by the feeler means to position the rudder of the ship so that when a difference between an actual value and the required value occurs, the regulating means tends to reduce the difference, the regulating means comprising:

an energy source in the form of a Venturi tube immersed in the water having high and low pressure openings:

a movable wall which is connected to the rudder and is arranged in a sealing manner between two working chambers; and valves connected to the working chambers that are actuated by the feeler means in such a way that when there is agreement between the actual and the required heading values, both working chambers are connected to the atmosphere and when there is a difference between heading values, the working chambers are connected respectively to the high and low pressure Venturi tube openings between which a pressure differential is generated.

7. An automatic steering device for a ship having a rudder, comprising:

means for sensing a change in the direction of an apparent wind relative to a desired ship's heading; and a linear actuator coupled directly to said rudder for applying rudder corrections, said linear actuator being controlled by said wind sensing means, the stroke of said linear actuator being proportional to a change in the direction of the relative wind.

said linear actuator being a collapsible chamber having a movable end wall that is coupled directly to said rudder, and a stationary end wall that is fastened to said ship;

a proportioning valve means is coupled to the interior of said chamber and actuated by said wind sensing means, for creating a pressure differential between the interior and exterior of said chamber the pressure differential being proportionate to the sensed change in direction of the apparent wind said proportioning valve means being further coupled by an actuating member to a lever of said wind sensing means.

8. The automatic steering device as defined in claim 7 wherein the collapsible chamber is spring-loaded and expands to a fully extended position when the internal and external pressures of said chamber are equalized.

* * * * *